US005627568A

United States Patent [19]

Sherlock et al.

[11] Patent Number: 5,627,568

[45] Date of Patent: May 6, 1997

[54] DISPLAY BUFFER USING MINIMUM NUMBER OF VRAMS

[75] Inventors: Ian J. Sherlock, Houston, Tex.; Richard D. Simpson, Bedford, England; Michael D. Asal, Sugarland, Tex.

[73] Assignee: Texas Instruments Incorporated, Dallas, Tex.

[21] Appl. No.: 990,971

[22] Filed: Dec. 15, 1992

[51] Int. Cl.[6] ..... G09G 5/00

[52] U.S. Cl. ..... 345/185; 345/203; 395/507

[58] Field of Search ..... 345/185, 197, 345/198, 200, 203, 201, 202; 395/164, 165, 166; 365/189, 195, 240, 230.3–230.9

[56] References Cited

U.S. PATENT DOCUMENTS

| | | | |
|---|---|---|---|
| 4,249,172 | 2/1981 | Watkins et al. | 345/185 |
| 4,404,554 | 9/1983 | Tweedy et al. | 345/185 |
| 4,648,077 | 3/1987 | Pinkham et al. | 365/240 |
| 4,802,117 | 1/1989 | Chrosny et al. | 364/900 |
| 5,210,639 | 5/1993 | Redwine et al. | 395/164 |
| 5,287,470 | 2/1994 | Simpson | 395/164 |
| 5,293,468 | 3/1994 | Nye et al. | 395/164 |
| 5,361,387 | 11/1994 | Millar et al. | 395/164 |
| 5,375,204 | 12/1994 | Motoyama et al. | 395/164 |
| 5,404,448 | 4/1995 | Bowen et al. | 395/164 |
| 5,434,969 | 7/1995 | Heilveil et al. | 395/164 |

*Primary Examiner*—Ulysses Weldon
*Assistant Examiner*—Amare Mengistu
*Attorney, Agent, or Firm*—Robert D. Marshall, Jr.; James C. Kesterson; Richard L. Donaldson

[57] ABSTRACT

A display buffer includes a plurality of memory banks, each said bank having a plurality of ordered rows of data storage locations. Circuitry controls the storage of a plurality of sequenced lines of display data in said display buffer. A first set of lines of display data is stored at contiguous locations in a first memory bank with the first word of a first line being stored in a location offset from the first location of the first row so a last word of a last line is stored in the last location of the last row. A second set of lines is stored at contiguous locations starting at the first row of the second memory bank. A last line of the second set of lines is stored so that the last word of this last line is stored in the last location of a selected row of the second bank. A third set of lines is stored in a third memory bank starting at a memory line other than the first memory line. If additional space is needed, the display lines wrap around to the first location of the first line of the third bank of memories. A graphics processor may provide the memory addressing and bank selection logic.

20 Claims, 4 Drawing Sheets

FIG. 5a
| 23 | 22 | 21 | 20 | 19 | 18 | 17 | 16 | LAD BUS |
|---|---|---|---|---|---|---|---|---|
| 0 | 0 | 0 | 0 | X | X | | | B0 |
| 0 | 0 | 0 | 1 | X | X | | | |
| 0 | 0 | 1 | 0 | X | X | | | |
| 0 | 0 | 1 | 1 | X | X | | | |
| 0 | 1 | 0 | 0 | X | X | | | B1 |
| 0 | 1 | 0 | 1 | X | X | | | |
| 0 | 1 | 1 | 0 | X | X | | | |
| 0 | 1 | 1 | 1 | 0 | 0 | | | |
| 0 | 1 | 1 | 1 | 1 | 1 | | | B2 |
| 1 | X | X | X | X | X | | | |
FIG. 5b
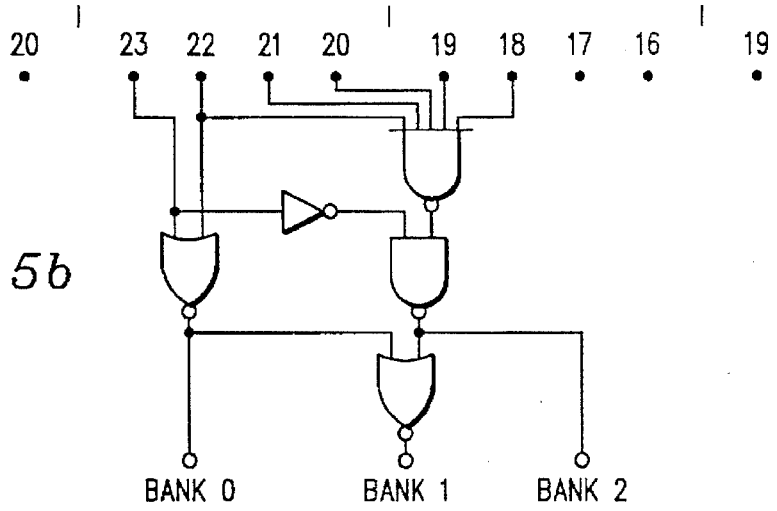
FIG. 5c
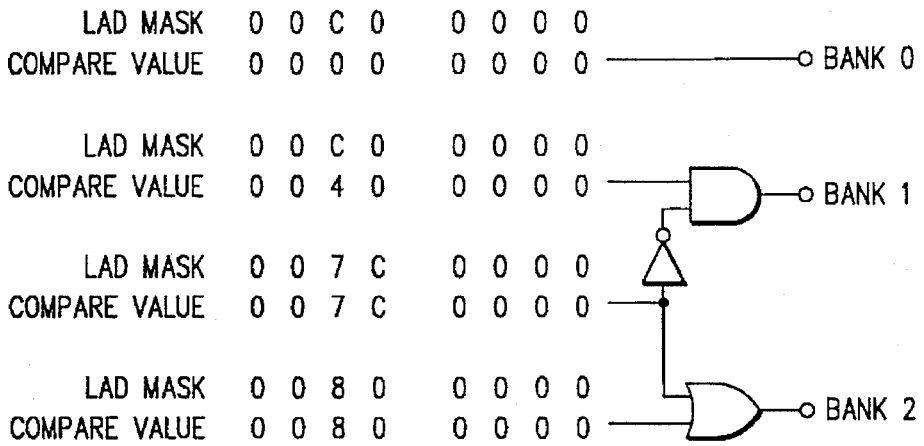

DISPLAY BUFFER USING MINIMUM NUMBER OF VRAMS

NOTICE (C) Copyright, *M* Texas Instruments Incorporated, 1990. A portion of the Disclosure of this patent document contains material which is subject to copyright protection. The copyright and mask work owner has no objection to facsimile reproduction by anyone of the patent document or the patent disclosure, as it appears in the U.S. Patent and Trademark Office, patent file or records, but otherwise reserves all rights in its copyright and mask work whatsoever.

TECHNICAL FIELD OF THE INVENTION

The present invention relates in general to processing systems and in particular to circuits, systems and methods for minimizing unused memory in a processing system.

BACKGROUND OF THE INVENTION

When designing a graphics system there are substantial cost advantages to be gained by minimizing amount of video random access memory (VRAM) used in the system display buffer. Several constraining factors dictate the absolute minimum amount of VRAM required in a particular system. The most important of these factors is the resolution of the system display. For example, a 1280×1024×8 display (i.e. a display arranged as an array of 1280×1024 pixels with 8 bits from the graphics processor defining each pixel) requires an absolute minimum of 1 ¼M bytes of VRAM.

Current display buffers are typically constructed with 256K×4 VRAM chips, therefore, if the display buffer is operating in conjunction with a 32 bit wide data bus, 8 VRAM chips are required per bank of memory. In this architecture, each bank provides 1 Mbyte of memory such that two banks are required to contain a 1280×1024×8 display. This disadvantageously leaves ¾ Mbyte of display buffer memory unused by the system. Given that VRAM costs are determined primarily by the number of storage bits per chip, such a large number of unused bits represents significant unnecessary costs.

Thus the need has arisen for circuitry, systems and methods which reduce the amount of unused RAM in processing systems. In particular, by reducing the amount of unused VRAM in a given graphics system, the significant advantage of cost reduction is achieved since VRAM bit per bit is relatively expensive.

SUMMARY OF THE INVENTION

Memory circuitry is provided which includes a plurality of memory banks, with each memory bank having a plurality of ordered rows of data storage locations including a first row and a last row, the storage locations of each row also ordered to include a first and a last storage location. Circuitry is also provided for controlling the storage of a plurality of sequences lines of data in the memory bank, each line of data comprising a plurality of sequenced data words. The circuitry for controlling storage of data in the memory banks is operable to store at least a portion of a first one of the sequences lines of data in the first row of the first one of the memory banks, the first word of the first line being stored in a location offset from the first location of the first row of the first memory bank such that the last word of the last line being stored in the first memory bank is stored in the last location of the last row of the first memory bank. The circuitry for controlling stores a first subsequent line in the sequence of lines in a second one of the memory banks, the first word of the first subsequent line being stored in a location in a row in a second bank other than the first row of the second bank. The circuitry for controlling then stores a second subsequent line of the lines being stored in the second bank such that a word of the second subsequent line is stored in the last location of the last row of the second bank and such that the next word of the sequenced words of the second subsequent line is stored in the first location in the first row of the second bank.

The present invention provides a means for reducing the amount of unused random access memory in a processing system. In particular, the present invention allows for a reduction of the amount of unused VRAM in a graphic system allowing for a significant overall system cost reduction.

BRIEF DESCRIPTION OF THE DRAWINGS

For a more complete understanding of the present invention, and the advantages thereof, reference is now made to the following descriptions taken in conjunction with the accompanying drawings, in which:

FIG. 5*a–c* depict example display buffer address decoding schemes for implementing the embodiment shown in FIG. 4.

DETAILED DESCRIPTION OF THE PREFERRED EMBODIMENTS

The preferred embodiment of the present invention and its advantages are best understood by referring to FIGS. 1 through 5 of the drawings, like numerals being used for like and corresponding parts of the various drawings.

Figure 1:
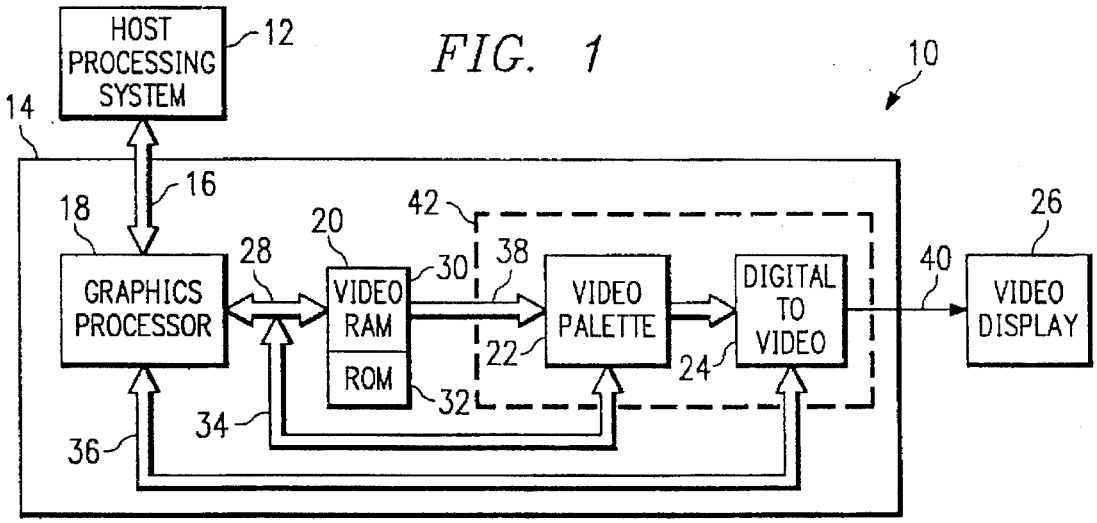
FIG. 1 is a functional block diagram of a graphics processor system utilizing one embodiment of the present invention.

FIG. 1 is a functional block diagram of a graphics computer system 10. Graphics computer system 10 includes a host processing system 12 coupled to a graphics processor board 14 through a bidirectional bus 16. Located on graphics processor board 14 are a graphics processor 18, memory 20, a video palette 22 and a digital-to-video converter 24. Video display 26 is driven by graphics board 14.

Host processing system 12 provides the major computational capacity for graphics computer system 10 and determines the content of the visual display to be presented to the user on video display 26. The details of the construction of host processing system 12 are conventional in nature and known in the art and therefore will not be discussed in further detail herein. Graphics processor 18 provides the data manipulation capability required to generate the particular video display being presented to the user. Graphics processor 18 may be for example a Texas Instruments TMS34020 graphics systems processor more completely described in the "TMS 34020 User's Guide" and the "TMS34020 Graphics System Processor Data Sheet", both published by and available from Texas Instruments Incorporated, Dallas, Tex., and incorporated herein by reference. Graphics processor 18 is bidirectionally coupled to processing system 12 via bus 16. While graphics processor 18 operates as a data processor independent of host processing system 12, graphics processor 18 is fully responsive to requests output from host processing 12. Graphics processor 18 further communicates with memory 20 via video memory bus 28. In the illustrated embodiment, bus 28 includes a 32-bit multiplexed local address/data bus and assorted row and column address lines. Graphics processor 12 controls the data stored within video RAM 30, VRAM 30 forming a portion of memory 20. In addition, graphics processor 18 may be controlled by programs stored in either video RAM 30 or in read-only memory 32. Read-only memory 32 may also include various types of graphic image data, such as alpha-numeric characters in one or more font styles, and frequently used icons. Further, graphics processor 12 controls data stored within video palette 22 via bidirectional bus 34. Finally, graphics processor 18 controls digital-to-video converter 24 via video control bus 36.

Video RAM 30 (the "display buffer") contains bit-map graphics data which control the video image presented to the user as manipulated by graphics processor 18. In addition, video data corresponding to the current display screen are output from video RAM 30 on bus 38 to video palette 22. As discussed in detail below, video RAM 30 may consist of banks of several separate random access memory integrated circuits, the output of each circuit typically being only one, four or eight bits wide as coupled to bus 38.

Video palette 22 receives high speed video data from video random access memory 30 via bus 38 and data from graphics processor 18 via bus 34. In turn, video palette 22 converts the data received on bus 38 into a video level which is output on bus 40. This conversion is achieved by means of a look-up table maintained in video palette 22 which is specified by graphics processor 18 via video memory bus 34. The output of video palette 22 may comprise color, hue and saturation signals for each picture element or may comprise red, green and blue primary color levels for each pixel. Digital-to-video converter 24 converts the digital output of video palette 22 into the necessary analog levels for application to video display 26 via bus 40. Together, video palette 22 and digital to video converter 24 make up the "backend" or simply "palette" 42.

Video display 26 receives the video output from digital-to-video converter 24 and generates the specified video image as a sequence of lines of pixels for viewing by the user of graphics computer system 10. Significantly, video palette 22, digital-to-video converter 24 and video display 26 may operate in accordance with either of two major video techniques. In the first technique, video data are specified in terms of hue, saturation and lightness for each individual pixel. In the second technique, the individual primary color levels of red, blue and green are specified for each individual pixel. Upon selection of the desired design using either of these two techniques, video palette 22, digital-to-video converter 24 and video display 26 are customized to implement the selected technique. However, the principles of the present invention in regard to the operation of the graphics processor 18 are unchanged regardless of the particular design choice of the video technique.

Figure 2:
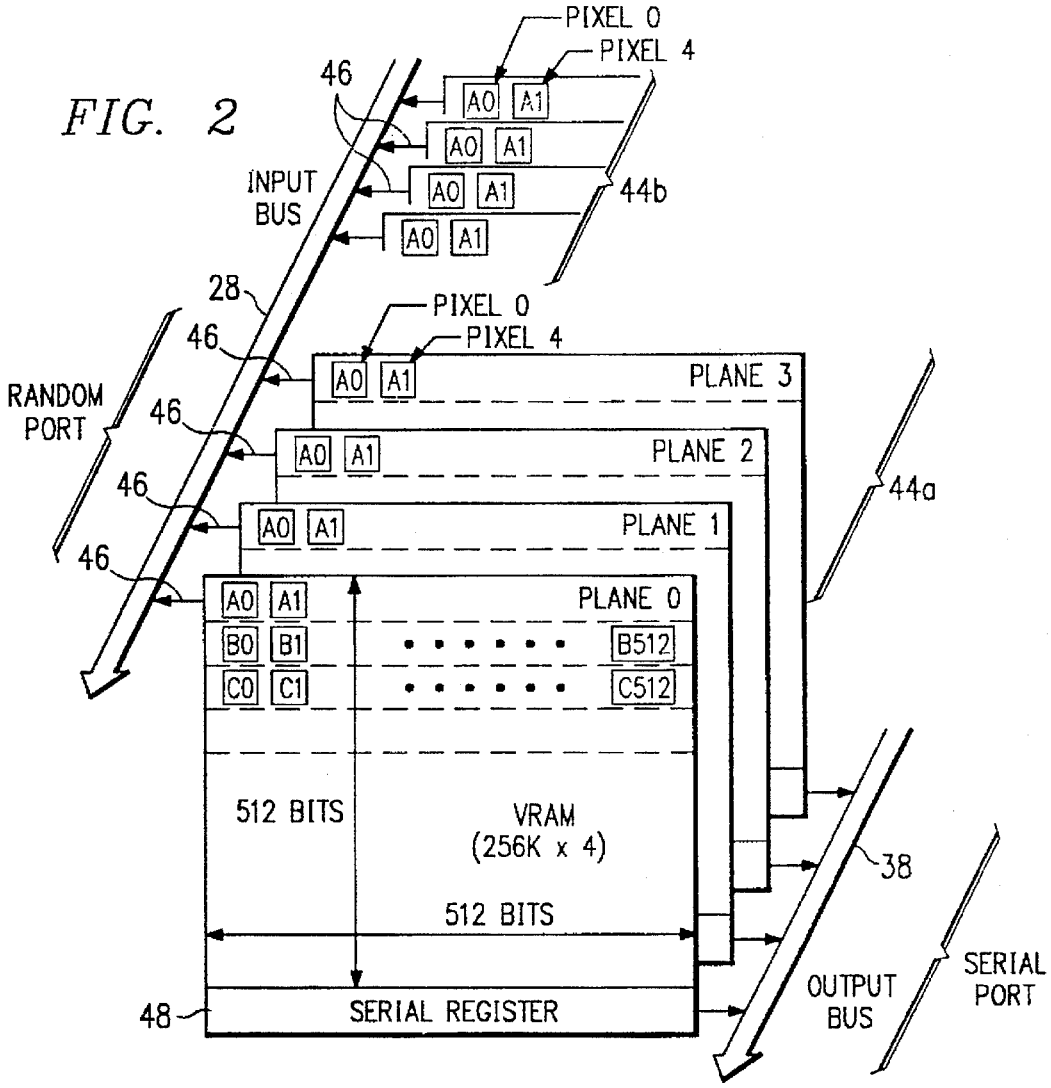
FIG. 2 is a schematic diagram depicting a typical video random access memory architecture for use in the graphics system of FIG. 1.

Referring next to FIG. 2, a graphics memory system configuration for video RAM 20 using 256k×4 VRAMs is depicted. When operating in conjunction with a 32-bit local address/data portion of bus 28, an array of eight VRAM memories 44 is used per bank, two of which are depicted as 44*a* and 44*b*. Each 256k×4 VRAM memory 44 has four 512×512-bit planes, 0, 1, 2 and 3. The construction of each plane is such that a single data lead 46 is used to exchange information to that plane. In FIG. 2, leads 46 represent the "random port" allowing the reading and writing of pixel data into a given location across the planes of one or more VRAM memories 44 in a manner similar to that used with a conventional RAM. In FIG. 2, VRAM memories 44 are arranged such that the pixel information for the graphics display is stored serially across the planes in the same row. Assuming an 8-bit word per pixel (or simply 8-bit pixel) system, then the bits for each pixel are stored across the planes of two 256k×4 VRAM memories 44 (if only four bits per pixel are being used, then one pixel would be stored across the planes of a single VRAM 44). In the 8-bits per pixel example of FIG. 2, pixel 0 is stored in locations A0 of VRAMs 44*a* and 44*b*. Pixels 1, 2, and 3 are then disposed in locations AO across the planes of the remaining 6 VRAMS forming the array of the bank (not shown for clarity). Pixel 4 is then located in locations A1 of VRAMs 44*a* and 44*b*, and so on.

Each VRAM plane has a serial register 48 for shifting out information from a row of memory. In the preferred embodiment, the shifting out is performed in response to a shift clock signal SCLK (not shown) generated on palette 42 (FIG. 1). The outputs from these registers (representing the "serial port" are connected in parallel bus 38 (a 32-bit bus in present illustrative embodiment). Thus, data from a row memory, such as row A, would be moved into registers 48 and output serially from each register 48 the array in parallel on bus 38.

Figures 3A, 3B, 3C:
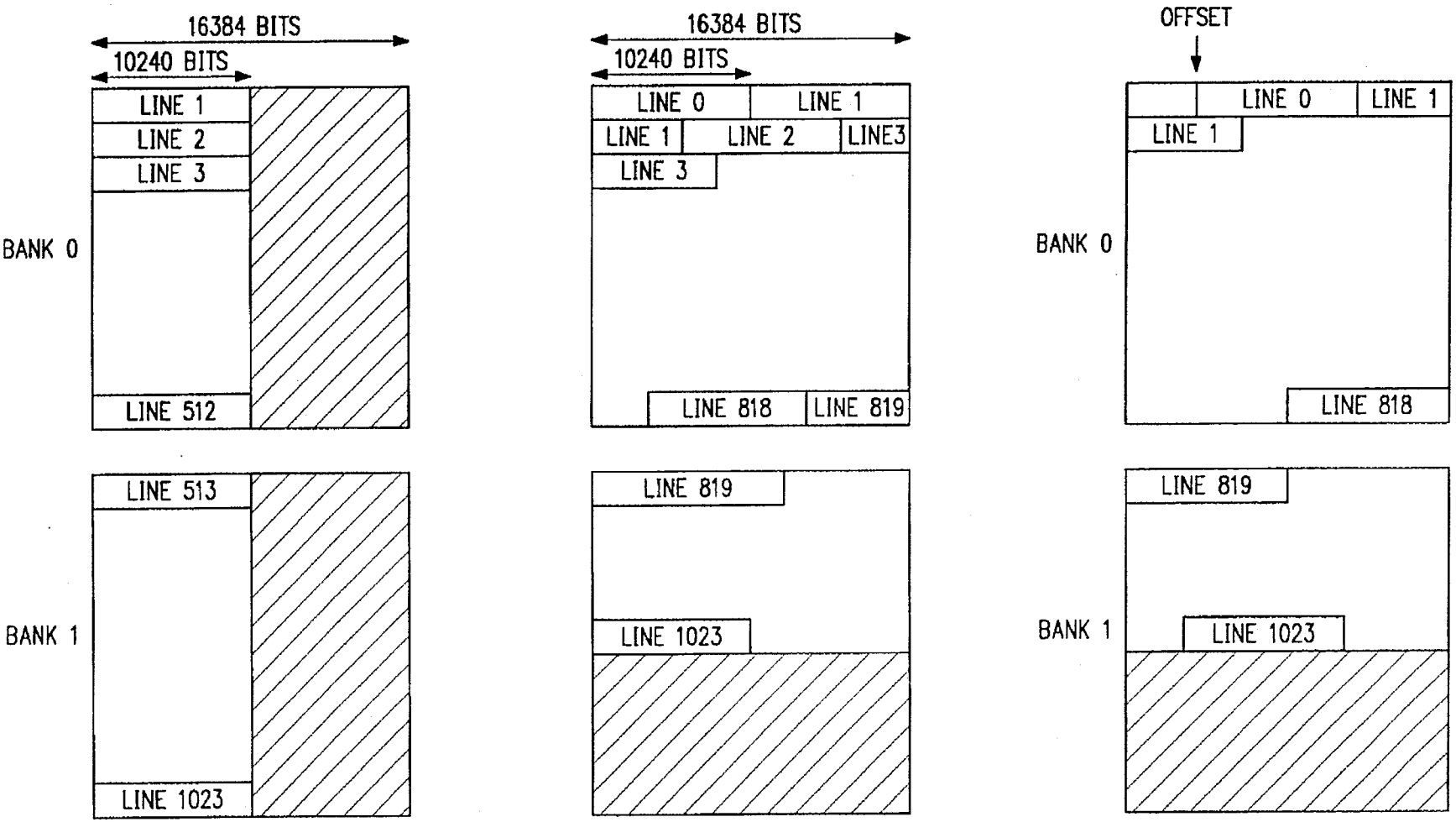
FIG. 3*a–c* depict possible methods of storing data in a graphics system display buffer.

FIG. 3*a* depicts the use of two banks, bank0 and bank1, of 256K×4 VRAMS containing a 1280×1024×8 display with unpacked lines of pixels. Each of the banks is shown in equivalent view of the architecture shown in FIG. 2 with all bit planes of all parallel VRAM devices 44 merged into one for clarity and simplicity. Note that with this arrangement, approximately ¾ Mbyte of memory (shown in the shaded area) remains unused. It is also important to note that in this unpacked arrangement the unused memory is not contiguous and is thus of limited use for holding data. FIG. 3*b* shows the same 1280×1024×8 display stored in 256k×4 VRAMs but with display (pixel) lines packed so the unused memory is contiguous. The disadvantage of the approach of FIG. 3*b* is that bank 0 ends in the middle of line 819. Without significant extra logic it is not possible to switch from one bank of memory to another in the middle of a display line making this packed display line scheme is impractical for a buffer design. FIG. 3*c* shows the same packed line arrangement of FIG. 3*b*, but this time the start of line 0 is offset so that the first bank of memory ends at the end of line 818. In this way a display buffer can be made which has all unused memory in a contiguous block, however, ¾ Mbyte of memory remains unused.

Figure 4:
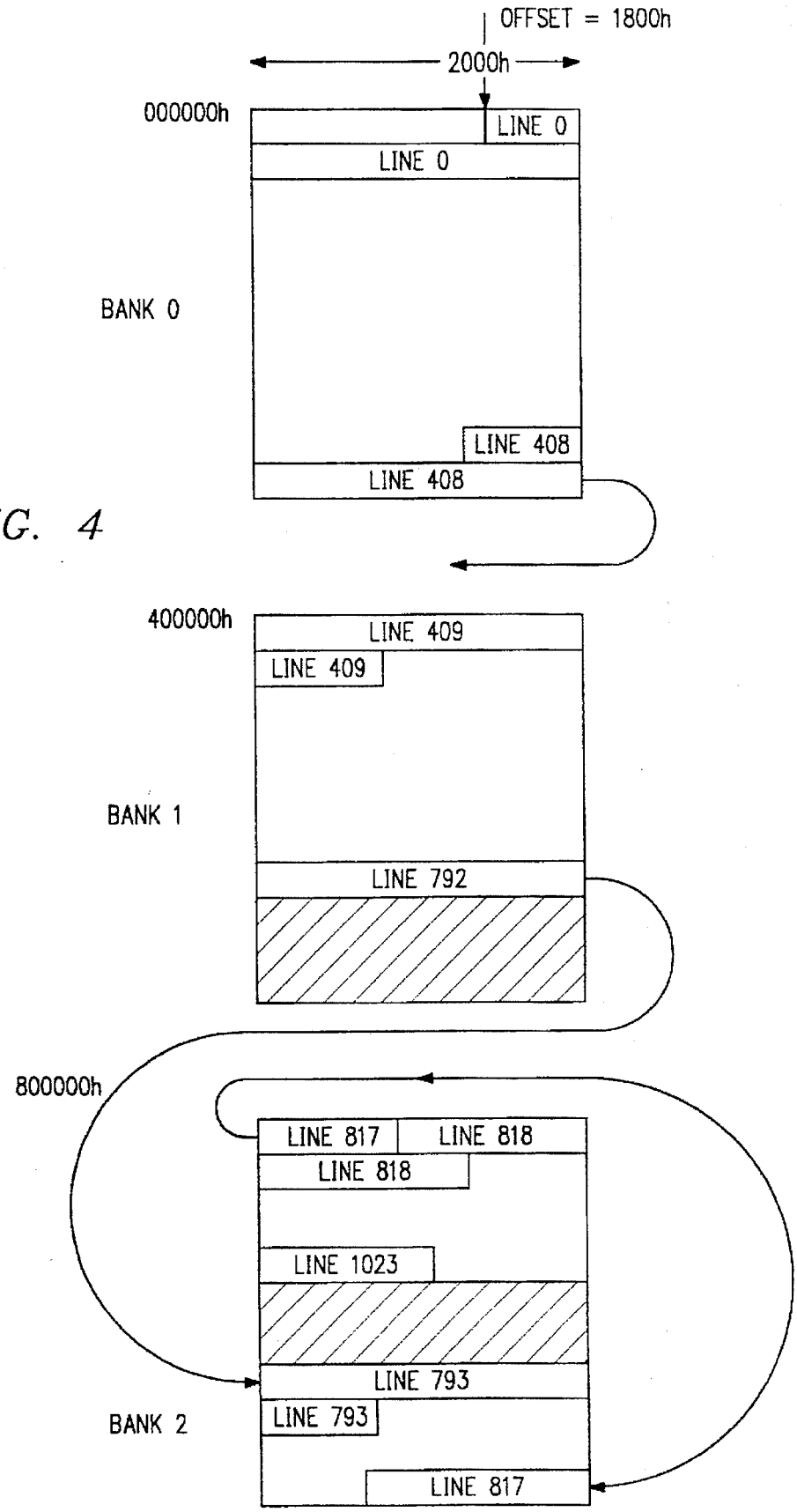
FIG. 4 depicts a method of storing data in a graphics system display buffer according to one embodiment of the present invention.

FIG. 4 depicts the use of 128K×8 VRAMS as a frame buffer holding a 1280×1024×8 display as an illustration of one embodiment of the present invention. In the illustrative example of FIG. 4, the amount of unused memory is reduced from approximately ¾ Mbyte to approximately ¼ Mbyte. In the illustrated embodiment, three banks (bank 0 bank 1 and bank 2) of 128kx8 VRAMS, each having 8 bit-planes of 512×256 bits, are provided and line packing is used. An offset of the first bit of line 0 along the first row ensures that last available locations (the last locations in the last row) stores the last pixel of line 408. In the depicted example, the first pixel of line 0 is offset from the first available memory location at address 000000h to the memory location at address 1800h such that the pixel for line 408 is held in the location at the address 3fffff, the last available address for bank 0. In alternate embodiments, the offset may vary depending on the length of the display lines and the bit-width provided by the planes of the VRAMs. Further, in alternate embodiments the number of lines packed in a given VRAM may also vary depending on the depth of the VRAMs.

Storage of pixel data (data words) in Bank 1 begins with the first pixel processed of line 409 being held in the first available location in the bank (first row, no offset), in this case at address 400000h. Lines of pixels are then stored in a packed fashion until the last pixel of line 792 is sent to the last location of row 383, in this example at address 7bffffh. Special decode logic, examples of which are discussed below, then detects attempts to address locations at or beyond address 07c0000h, in which case bank 2 is selected. This has the effect of ending bank 1 at the exact end of line 792.

The next address 7cooooh is now used to place the start of line 793 in a row in the lower half of bank 2. Bank 2 now ends part way through line 817 at address 7fffffh. The next pixel of line 817 is then sent to the first location in bank 2 using the next address in sequence, address 800000h. Since the rest of line 817 is stored within the same bank at a logically contiguous location, the shift register re-load proceeds correctly.

In the example scheme shown in FIG. 4, the unused memory is minimized with only 32K unused bytes in bank 1 and approximately 224K unused bytes in bank 2. The primary advantage of the illustrative scheme is that the display buffer for a 1280×1024×8 display can be fit into 3 banks of 128K×8 VRAMS. This saves PCB space and cuts the system cost. An additional advantage is that the two blocks of unused memory are contiguous within themselves.

FIGS. *5a–5c* are representative implementations of the address decode scheme for a 1280×1024×8 display contained in three banks of 128K×8 VRAM discussed above. In FIGS. *5a–5c*, the addressing schemes are defined using the local address/data bus line designations for the Texas Instruments TMS34020 as an example only (in FIG. 1, the corresponding local address/data forms part of bus 28). Reference is again made to the "TMS 34020 User's Guide" (January 1990) and the "TMS34020 Graphics System Processor Data Sheet" (October 1990), available from Texas Instruments and incorporated herein by reference. Similar addressing schemes may be used with alternate graphics processors as understood by those skilled in the art; the inventive concepts described using this example remain the same. The decoding scheme shown in FIG. *5c* uses mask/compare logic that already exist for use in four bank systems. Thus chips such as the Texas Instruments TMS34094 designed to work with a four bank system can easily be adapted to the more economical three bank scheme. The and/or logic used to process the output of the comparators can also be easily generalized to accommodate systems with more banks.

The idea of using an address decode scheme to enable a minimum VRAM system to be built has applications across a range of display resolutions, pixel sizes, buffer widths, VRAM designs and so on. The 1280×1024×8 in a 32 bit wide buffer of 128K×8 VRAMs is just one specific example.

Although the present invention and its advantages have been described in detail, it should be understood that various changes, substitutions and alterations can be made herein without departing from the spirit and scope of the invention as defined by the appended claims.

What is claimed is:

1. Memory circuitry comprising:

a plurality of memory banks, each said memory bank having a plurality of ordered rows of data storage locations including a first row and a last row, said data storage locations of each row ordered and including a first data storage location and a last data storage location;

circuitry for controlling the storage of a plurality of sequenced lines of data in said memory banks, each said sequenced line of data comprising a plurality of sequenced data words, said circuitry for controlling operable to:

store sequenced lines of data in contiguous locations in a first one of said memory banks, a first word of a first one of said sequenced lines of data being stored in a location offset from said first data storage location of said first row of said first memory bank such that a last word of a last line being stored in said first memory bank is stored in said last data storage location of said last row of said first memory bank;

store a first subsequent line of data of said sequenced of lines of data in a subsequent one of said memory banks, a first word of said first subsequent line of data being stored in a data storage location in a row in said subsequent memory bank other than said first row of said subsequent memory bank; and store a second subsequent line of data of said sequenced lines of data being stored in said subsequent memory bank such that a said word of said second subsequent line of data is stored in said last data storage location of said last row of said subsequent memory bank and a next word of said sequenced words of said second subsequent line of data is stored in said first data storage location in said first row of said subsequent memory bank.

2. The memory circuitry of claim 1 wherein said memory banks comprise a plurality of random access memory devices.

3. The memory circuitry of claim 1 wherein said memory banks comprise a plurality of video random access memory devices.

4. The memory circuitry of claim 1 wherein said plurality of memory banks are configured as a display buffer.

5. The memory circuitry of claim 1 wherein said circuitry for controlling includes a processor.

6. The memory circuitry of claim 1 wherein said circuitry for controlling includes a graphics processor.

7. The memory circuitry of claim 1 wherein said sequenced lines of data comprise lines of video data with each said data word comprising data defining a pixel.

8. The memory circuitry of claim 4 wherein said display buffer comprises a plurality of 128k×8 video random access memory devices for holding video data defining a 1280×1024×8 video display.

9. Display buffer circuitry comprising:

a display buffer comprising a plurality of banks of random access memory devices, each said bank of random access memory device having a plurality of ordered rows of data storage locations including a first row and a last row, said storage locations of each row ordered and including a first data storage location and a last data storage location;

circuitry for controlling the storage of a plurality of sequenced lines of display data in said display buffer, each said sequenced line of display data comprising a plurality of sequenced data words each defining a pixel, said circuitry for controlling operable to:

store sequenced lines of display data in contiguous locations in a first one of said banks of random access memory devices, a first word of a first one of said sequenced lines of display data being stored in a location offset from said first data storage location of said first row of said first bank of random access memory devices such that a last word of a last line of display data being stored in said first bank of random access memory devices is stored in said last data storage location of said last row of said first bank of random access memory devices;

store a next line of said sequenced lines of display data in said first row of a second one of said banks of random access memory devices, a first word of said next line of display data being stored in said first data storage location of said first row of said second bank of random access memory devices;

store a last one of said sequenced lines of display data being stored in said second bank of random access memory devices such that a last word of said last one of said lines of display data is stored in said last data storage location of a selected row of said second bank of random access memory devices;

store a following said line of data in said sequenced lines of display data in a third one of said banks of random access memory devices, a first word of said following line of display data being stored in a location in a row in said third bank of random access memory devices other than said first row of the third bank of random access memory devices; and store a subsequent line of display data of said sequenced lines of display data being stored in said third bank of random access memory device such that a said word of said subsequent line of display data is stored in said last data storage location of said last row of said third bank of random access memory devices and a next word of said sequenced words of said subsequent line of display data is stored in said first data storage location in said first row of the third bank of random access memory devices.

10. The display buffer circuitry of claim 9 wherein said random access memory devices comprise video random access memory devices.

11. The display buffer circuitry of claim 9 wherein said circuitry for controlling is operable to store said sequenced lines in a packed format.

12. The display buffer circuitry of claim 11 wherein said display buffer is configured to contain display data defining a 1280×1024×8 display.

13. The display buffer circuitry of claim 9 wherein said circuitry for controlling comprises a graphics processor.

14. The display buffer circuitry of claim 13 wherein said circuitry for controlling further comprises bank selection logic circuitry.

15. The display buffer circuitry of claim 14 wherein said bank selection circuitry is coupled to a local address/data bus coupling said processor with said display buffer.

16. A graphics processing system comprising:

a host processing system for determining the contents of a selected visual display to be presented on a video display unit as a plurality of pixels;

a display buffer comprising a plurality of banks of video random access memory devices, each said bank of video random access memory devices having a plurality of ordered rows of data storage locations including a first row and a last row, said storage locations of each row ordered and including a first data storage location and a last data storage location;

a graphics processor coupled to said host processing system and said display buffer for generating said selected visual display as a plurality of sequenced lines of display data in said display buffer, each said sequenced line of display data comprising a plurality of sequenced data words defining a said pixel, said graphics processor operable to:

store sequenced lines of display data in contiguous locations in a first one of said banks of video random access memory devices, a first word of a first one of said sequenced lines of display data being stored in a location offset from said first data storage location of said first row of said first bank of video random access memory device such that a last word of a last line of display data being stored in said first bank of video random access memory devices is stored in said last data storage location of said last row of said first bank of video random access memory devices;

store a next line of display data in said sequenced lines of display data in said first row of a second one of said banks of video random access memory devices, a first word of said next line of display data being stored in said first data storage location of said first row of said second bank of video random access memory devices;

store a last line of display data of said sequenced lines of display data being stored in said second bank of video random access memory devices such that a last word of said last one of said lines of display data is stored in said last data storage location of a selected row of said second bank of video random access memory devices;

store a following said line of display data of said sequenced lines of display data in a third one of said banks of video random access memory devices, a first word of said following line of display data being stored in a location in a row in said third bank of video random access memory devices other than said first row of the third bank of video random access memory devices; and store a subsequent line of display data of said sequenced lines of display data being stored in said third bank of video random access memory devices such that a said word of said subsequent line of display data is stored in said last data storage location of said last row of said third bank of video random access memory device and a next word of said sequenced words of said subsequent line of display data is stored in said first data storage location in said first row of the third bank of video random access memory devices; and backend circuitry coupled to said graphics processor and said display buffer for driving said display unit.

17. The graphics processing system of claim 16 wherein said backend circuitry includes a color palette.

18. The graphics processing system of claim 16 wherein said graphics processor controls storage of data in said display buffer via a local address/data bus and associated bank selection logic circuitry.

19. A method of storing a plurality of sequenced data lines, each data line comprising a plurality of sequenced data words including a first word and a last word, in a memory system comprising a plurality of memory banks, each bank having a plurality of ordered rows of data storage locations including a first row and a last row, the storage locations of each row ordered and including a first and a last storage location, the method comprising the steps of:

storing at least a portion of a first one of the sequenced data lines in the first row of a first one of the memory banks, the first word of the first line being stored in a location offset from the first location of the first row such that the last word of a last line being stored in the first bank is stored in the last location of the last row of the first memory bank;

storing the next line in the sequence of lines in the first row of a second memory bank, the first word of the next line stored in the first location of the first row of the second bank;

storing a last one of ones of the lines being stored in the second bank in the locations of the second bank such that the last word of the last line being stored in the second bank is stored in the last location of a selected row;

storing the following line in the sequence of lines in a third memory bank, the first word of the following line being stored in a location in a row other than said first row of the third memory bank; and storing a subsequent line of ones of the lines being stored in the third memory bank in the locations of the third memory bank such that a word of the subsequent line is stored in the last location of the last row of the third bank and the next word in the sequence of words of the subsequent line is stored in the first location in the first row of the third memory bank.

20. The method of claim 19 wherein said steps of storing comprise the steps of storing the lines of data in a packed format.

* * * * *